United States Patent [19]

Stucki

[11] Patent Number: 4,943,115

[45] Date of Patent: Jul. 24, 1990

[54] SWIVEL CHAIR WITH ADJUSTABLE BACK REST

[75] Inventor: Felix Stucki, Thunstetten, Switzerland

[73] Assignee: Girsberger Holding AG, Bützberg, Switzerland

[21] Appl. No.: 401,471

[22] Filed: Aug. 29, 1989

Related U.S. Application Data

[63] Continuation of Ser. No. 262,101, Oct. 18, 1988, abandoned, which is a continuation of Ser. No. 92,328, Sep. 2, 1987, abandoned.

[30] Foreign Application Priority Data

Sep. 2, 1986 [DE] Fed. Rep. of Germany ..... 3629882

[51] Int. Cl.[5] ..... A47C 1/032

[52] U.S. Cl. ..... 297/301; 297/302

[58] Field of Search ..... 297/301, 300, 302, 304

[56] References Cited

U.S. PATENT DOCUMENTS

| | | | |
|---|---|---|---|
| 2,430,604 | 11/1947 | Dorton | 297/369 |
| 4,603,905 | 8/1986 | Stucki | 297/300 |
| 4,629,249 | 12/1986 | Yamaguchi | 297/300 |
| 4,650,248 | 3/1987 | Borsani | 297/300 |

*Primary Examiner*—Peter R. Brown

*Attorney, Agent, or Firm*—Peter K. Kontler

[57] ABSTRACT

A chair wherein the support at the upper end of the leg has a rigidly mounted carrier for the front portion of the seat and a carrier for the back rest. The carrier for the back rest is connected to the carrier for the seat by a coupling which allows angular and translatory movements of the carrier for the back rest. A detent mechanism is provided to hold the back rest in any one of several different positions of inclination with reference to the seat. One element of the detent mechanism is a toothed rack on a slide which is connected with the carrier for the back rest and is reciprocable in a slot of the carrier for the seat. Another element of the detent mechanism is a lever which has one or more teeth movable into and from mesh with the teeth of the rack by a mechanism which can pivot the lever against the opposition of a torsion spring. The spring or springs which pemanently tend to pivot the back rest forwardly prevent the torsion spring from disengaging the teeth of the lever from the teeth of the rack; to this end, the flanks of teeth on the rack are configurated in such a way that the spring or springs for the back rest maintain the flanks in pronounced frictional engagement with the teeth of the lever, and such frictional engagement can be overcome by the torsion spring when the occupant of the seat leans against the back rest so as to reduce the bias of the spring or springs for the back rest upon the tooth flanks.

18 Claims, 5 Drawing Sheets

SWIVEL CHAIR WITH ADJUSTABLE BACK REST

CROSS-REFERENCE TO RELATED APPLICATION

This application is a continuation of application Ser. No. 262,101, filed Oct. 18, 1988, now abandoned which is a continuation of Ser. No. 092,328, filed Sep. 2, 1987, now abandoned.

The chair of the present invention is similar to the swivel chair which is disclosed in the commonly owned copending patent application Ser. No. 092,325 filed Sep. 2, 1987 by Fritz Makiol for "Swivel Chair".

BACKGROUND OF THE INVENTION

The invention relates to seating facilities in general, and more particularly to improvements in chairs, especially swivel chairs. Still more particularly, the invention relates to improvements in chairs of the type wherein the seat and/or the back rest is adjustable, especially in such a way that any, or at least certain, adjustments of one of these parts involve an automatic adjustment of the other part.

It is known to mount the seat and the back rest of a chair, such as a swivel chair, on a support which is located at the upper end of an upright column forming part of the leg of the chair. The seat is pivotable forwardly and backwards, the same as the back rest. It is also known to provide a specially designed coupling which movably connects the seat with the back rest in such a way that these parts can perform translatory as well as angular movements relative to each other. To this end, the seat or a carrier which is secured to the seat is provided with an elongated slot, and the back rest or a carrier which is connected to the back rest has a slide which is reciprocable in the slot. The positions of the slot and slide can be reversed, i.e., the slot can be provided in the back rest or in a carrier which shares the movements of the back rest. The adjusting mechanism for moving the seat and the back rest relative to each other in directions which are determined by the coupling normally comprises a gas spring (e.g., an air spring of the type disclosed in commonly owned U.S. Pat. No. 4,603,905 granted Aug. 5, 1986) which can begin to change the positions of the seat and back rest relative to each other in response to disengagement or loosening of a suitable locking device, e.g., a handle which is to be manipulated by hand. An important function of the gas spring is to damp the movements of the seat and back rest relative to each other, i.e., to prevent abrupt extensive changes in mutual positions of the seat and back rest such as could startle and/or injure the occupant of the chair.

It has been found that a gas spring is not always reliable, especially after extensive wear. Therefore, attempts were made to use conventional extension and/or compression springs. However, a standard mechanical spring which is called upon to store a substantial amount of energy will invariably tend to rapidly dissipate energy when permitted to do so; therefore, chairs employing adjusting mechanisms with such springs are also likely to startle or even injure the occupant who wishes to change the inclination of the seat and back rest. For example, the back rest is likely to abruptly pivot and/or otherwise move from a rearwardly inclined position to an upright position to thereby strike the back of the occupant or to propel the occupant forwardly if the body of the occupant is in contact with the back rest when the latter is permitted to move in response to abrupt dissipation of energy by one or more strong compression or extension springs.

European Pat. No. 0 001 846 B1 discloses a chair wherein the means for biasing the back rest comprises a standard spring and the inclination of the back rest can be altered only in response to the application of a force which acts upon the back rest and tends to pivot it rearwardly. A drawback of the chair which is disclosed in this patent is that the adjusting mechanism occupies an inordinately large amount of space and cannot be readily installed in a compact chair.

German Auslegeschrift No. 23 41 790 discloses a swivel chair wherein a coil spring urges the back rest to its foremost position and the rigid frame of the seat is connected with a box-like part which is pivotably connected with a box-like forwardly extending first arm of an L-shaped lever having an upwardly extending second arm which supports the back rest. The upwardly extending arm contains a mechanism which can raise or lower the back rest. The first arm of the lever carries a pivotable gear segment adapted to be locked in a selected position by a pawl which is pivotable by a handle. The inventors named in this publication are concerned with a modular adjusting mechanism which can be designed to afford greater or lesser comfort to the occupant of the chair, depending on the cost of the chair.

OBJECTS AND SUMMARY OF THE INVENTION

An object of the invention is to provide a chair, such as a swivel chair, which is constructed and assembled in such a way that the movements of the back rest and/or seat relative to the support for such parts can be damped and otherwise controlled even if the adjusting mechanism of the chair does not employ a gas spring.

Another object of the invention is to provide novel and improved means for preventing abrupt changes in the position of the back rest and/or seat with reference to its support.

A further object of the invention is to provide a chair wherein the back rest and/or the seat can be biased to an end position by one or more strong or very strong springs without the danger of startling, shocking and/or injuring the occupant during adjustment.

An additional object of the invention is to provide a novel and improved coupling between relatively movable parts of a chair having an adjustable seat and/or back rest.

Still another object of the invention is to prevent abrupt forward propulsion of the back rest of a swivel chair or a similar seating facility in response to disengagement of the mechanism for releasably locking the back rest and/or the seat in a selected position.

A further object of the invention is to provide a novel and improved detent mechanism for use in the above outlined chair.

Another object of the invention is to provide a novel and improved connection between mutually movable parts of a support for the back rest and seat in a swivel chair.

An additional object of the invention is to provide a novel and improved method of controlling the movements of the back rest and/or seat in a swivel chair from one end position toward the other end position.

A further object of the invention is to provide a novel and improved support for use in the above outlined chair.

The invention is embodied in a chair which includes a leg comprising a support which has first and second carriers, a seat on the first carrier, a back rest on the second carrier, and means for movably coupling the carriers to each other. The coupling means comprises a slotted portion provided on one of the carriers, a slide portion provided on the other carrier and being movable in the slotted portion between a plurality of different positions in and counter to a predetermined direction, and detent means including cooperating first and second detent elements which are movable relative to each other and are respectively provided on the slide portion and the one carrier. The detent elements have means for releasably holding the slide portion in any one of several selected positions of the plurality of different positions. The holding means preferably include complementary teeth provided on the first and second detent elements and extending transversely of the predetermined direction. Such complementary teeth are in frictional mating engagement with each other in each of the selected positions in the absence of transmission of stresses to the second carrier by the back rest and while the seat is not acted upon by a force (e.g., by the weight of the occupant of the chair) or is acted upon by a force tending to pivot the set rearwardly.

In accordance with a presently preferred embodiment of the invention, the first detent element includes a toothed rack having tooth spaces between its teeth, at least one tooth space for each selected position of the slide portion. The second detent element then comprises a holder and means for movably mounting the holder on the one carrier so that the holder does not share the movements of the slide portion with reference to the one carrier. The holder has at least one tooth which is received in a different tooth space of the rack in each selected position of the slide portion. The holder can include a lever which is pivotally mounted on the one carrier and has at least one arm. The at least one tooth of the second detent element is provided on such arm.

The chair further comprises means for biasing the at least one tooth against the adjacent tooth of the rack in each selected position of the slide portion in the absence of transmission of stresses from the seat and/or back rest to the respective carrier or carriers of the support. The teeth of the rack have flanks which are engaged by the at least one tooth in the corresponding selected positions of the slide portion, and such engaged flanks are disposed in substantially parallel planes which are preferably normal or nearly normal to the predetermined direction.

The chair preferably further comprises means for yieldably urging the holder in a direction to disengage the at least one tooth from the rack, and means for moving the holder against the opposition of the urging means so as to engage the at least one tooth with the rack. The moving means can include a motion transmitting member which is movable to at least one releasing position in which the urging means is free to disengage the at least one tooth from the rack.

The lever can constitute a bell crank lever with a first arm for the at least one tooth and a second arm, and the moving means then includes means for pivoting the bell crank lever in a direction to disengage the second detent element from the first detent element. The motion transmitting member of the pivoting means is connected with the second arm, and the moving means further comprises a mechanism for moving the motion transmitting member. An elastic cushion can be interposed between the mechanism and the motion transmitting member. For example, the motion transmitting member can constitute or include a rod which is reciprocable by the lever (in one direction) and by the mechanism (in the opposite direction) and includes a collar or an analogous retainer for the cushion. The mechanism can include an actuator for the rod, and the cushion can include a spring (e.g., a coil spring) which reacts against the actuator and bears against the retainer.

In accordance with a modification, the rack can include a plate with an opening (e.g., a window) which extends in the predetermined direction, and the plate has at least one row of teeth which are located in the opening and the row extends in the predetermined direction. The second detent element of such detent means has at least one tooth which is movable into and from the opening to engage a different tooth of the row of teeth in the opening in each selected position of the slide portion. The rack can be provided with an additional row of teeth which row is parallel to the at least one row, and the second detent element then comprises at least one additional tooth which is movable into and out of mesh with the teeth of the additional row. The arrangement may be such that the second detent element has a first set of several teeth (e.g., five teeth) which are movable into and out of mesh with the teeth of the at least one row, and a second set of several (e.g., five) additional teeth movable into and out of mesh with the teeth of the additional row. The thickness of the plate-like rack can be less than one centimeter (e.g., two, three or four millimeters), and the at least one tooth can have a depth which equals or approximates the thickness of the plate-like rack.

The support (or a portion of the support) is or can be hollow, and the detent means is or can be installed in the interior of such support.

The novel features which are considered as characteristic of the invention are set forth in particular in the appended claims. The improved chair itself, however, both as to its construction and the mode of operating the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
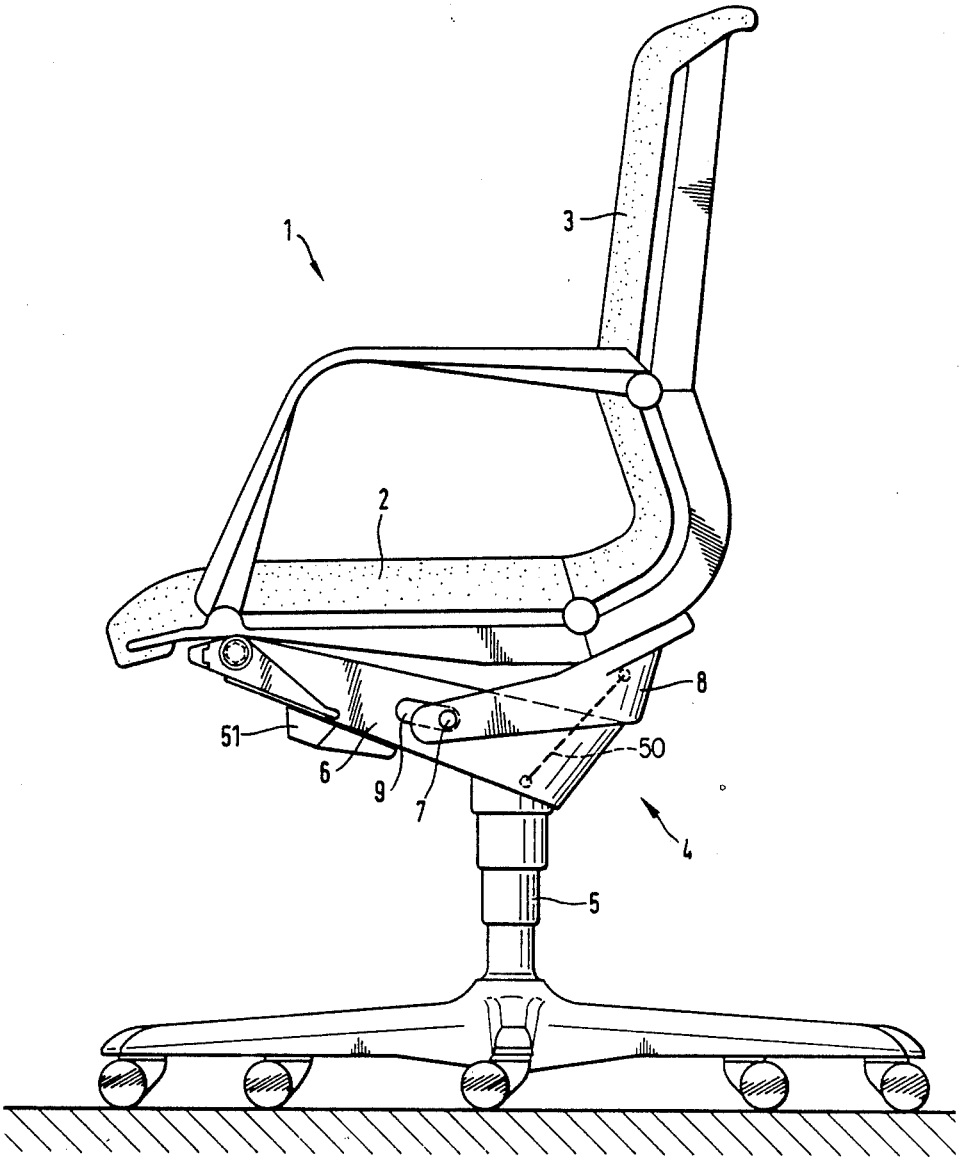
FIG. 1 is a schematic elevational view of a swivel chair which embodies the invention.

Referring first to FIG. 1, there is shown a swivel chair 1 which includes a leg having an upright column 5 and a support 4 which is carried by the upper end of the column. The column 5 forms part of or contains customary means for raising or lowering the seat 2 and the back rest or back support 3 of the chair 1. In accordance with a feature of the invention, the support 4 includes a forwardly extending portion or carrier 6 whose front end is articulately connected with the front portion of the seat 2, and a rearwardly extending portion or carrier 8 which is rigidly connected with the back rest 3. The back rest 3 and the seat 2 can be constructed, movably secured to each other and mounted on the respective carriers in a manner as disclosed in the aforementioned copending patent application for "Swivel Chair". The carrier 6 has a rear portion which is secured to the main portion of the support 4 and which is further connected to the front portion of the carrier 8 by a coupling 7 of the type shown in FIGS. 2 and 3. The coupling 7 is designed in such a way that it enables the carriers 6, 8 (and hence the seat 2 and back rest 3) to perform translatory as well as pivotal movements relative to each other.

Figure 2:
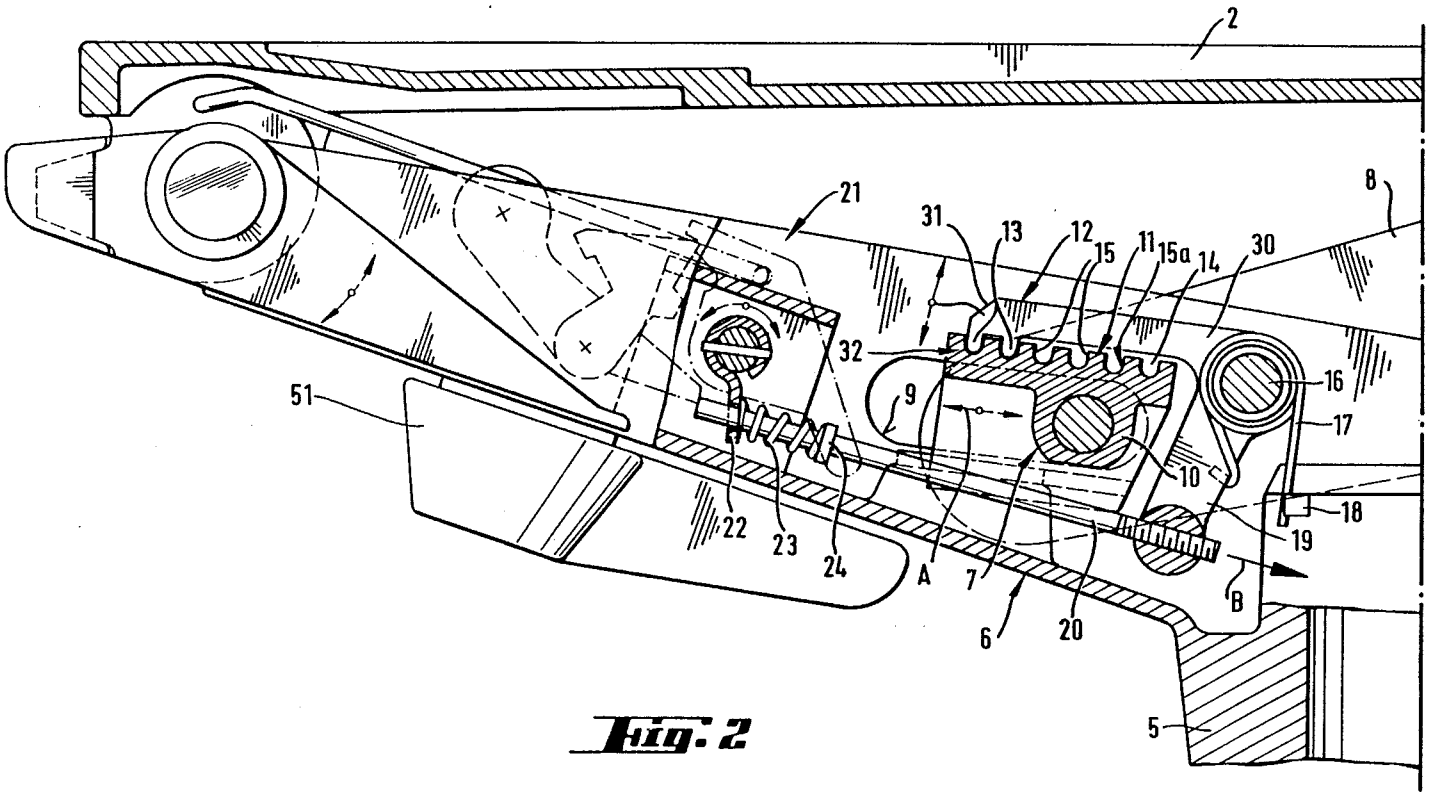
FIG. 2 is an enlarged fragmentary vertical sectional view of the support and of the coupling means in the swivel chair of FIG. 1.
Figure 3:
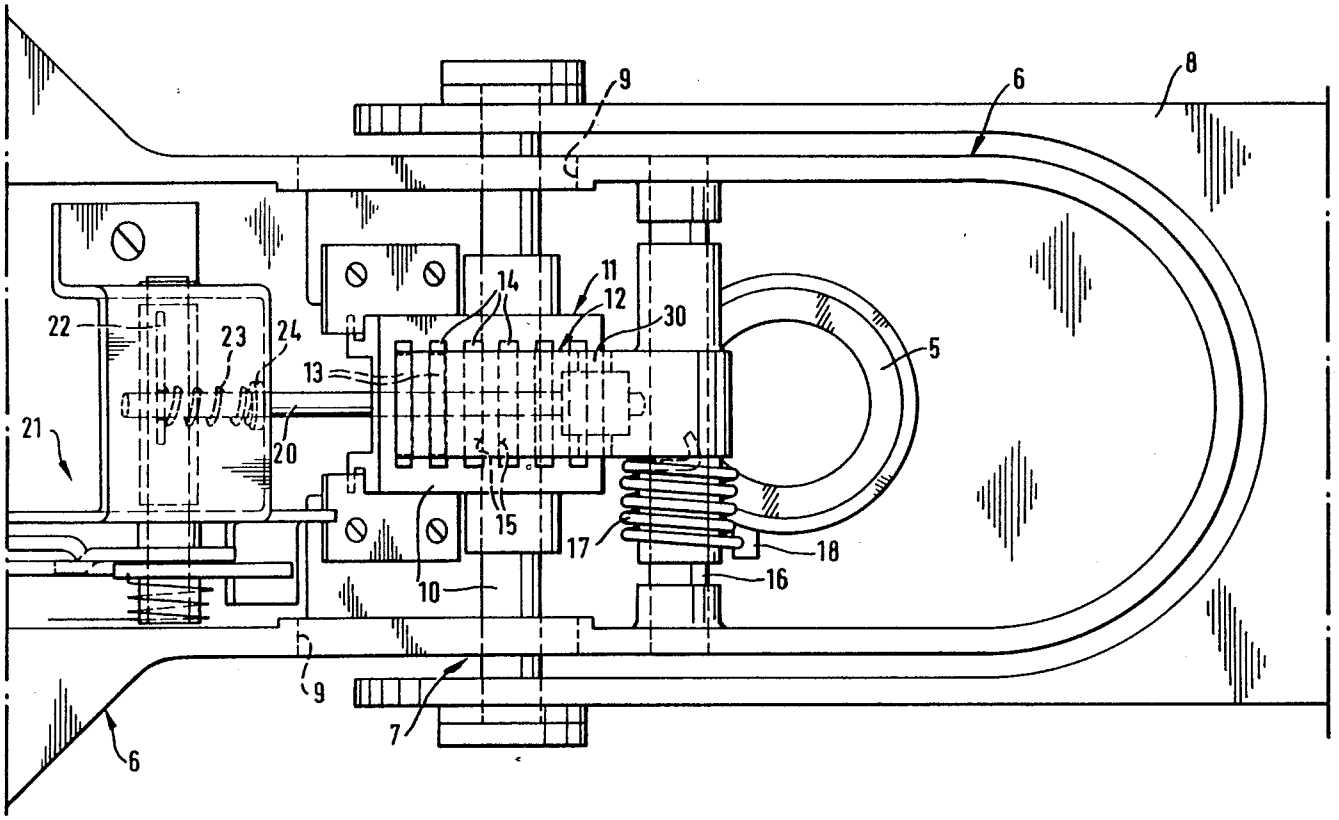
FIG. 3 is an enlarged fragmentary horizontal sectional view of the support and coupling means shown in FIG. 2.

As shown in FIGS. 2 and 3, the coupling 7 comprises a portion of the carrier 6 which can be said to constitute the rear part of the carrier 6 and has an elongated slot 9 extending in the longitudinal direction of the carrier 6, i.e., from the front toward the rear end of the seat 2. The coupling 7 further comprises a slide portion 10 which is provided on and can be said to form part of the carrier 8 and is slidable in the slot 9 in directions indicated by a double-headed arrow A. Still further, the coupling 7 comprises or cooperates with a novel detent device including a first detent element 11 which comprises a toothed rack 32, and a second detent element 12 including a holder 30 which is movably mounted on the carrier 6 by a horizontal shaft 16. The illustrated holder 30 is a bell crank lever having a first arm 31 which overlies the rack 32 of the first detent element 11 and a second arm 19 which is biased in a clockwise direction by a torsion spring 17 serving as a means for yieldably urging the first arm 31 of the lever 30 away from engagement with the rack 32. One leg of the torsion spring 17 reacts against a stop 18 in the carrier 6 and the other leg of this spring bears against the arm 19 of the lever 30.

The means for releasably holding the detent elements 11, 12 in engagement with each other includes teeth 15 on the rack 32 of the detent element 11 and one or more complementary teeth 13 on the arm 31 of the lever 30. The teeth 15 alternate with tooth spaces 14 for the teeth 13, and each tooth 15 has a flank 15*a* which extends substantially at right angles to the direction of arrow A and is located in a plane extending at right angles to the plane of FIG. 2. The number of tooth spaces 14 at least equals the number of selected (intermediate) positions in which the carrier 8 can be held with reference to the carrier 6 by the detent elements 11 and 12 so that each tooth 13 of the arm 31 enters a different tooth space 14 in each selected position of the carrier 8. FIG. 2 shows the detent element 12 in engagement with the detent element 11, i.e., each of the teeth 13 extends into the adjacent tooth space 14 and abuts the corresponding flank 15*a* of the adjacent tooth 15.

The chair 1 further comprises means for moving (pivoting) the lever 30 about the axis of the shaft 16 against the opposition of the torsion spring 17. Such moving means comprises an elongated motion transmitting member 20 in the form of a rod one end portion of which is articulately connected to the free end portion of the arm 19 of the lever 30 and the other end portion of which has a retainer 24 in the form of a collar which is acted upon by an elastic cushion in the form of a coil spring 23. The latter reacts against the actuator 22 of a mechanism which further includes a pawl 21 and serves to move the rod 20 forwardly (arrow B in FIG. 2) in order to engage the teeth 13 with the adjacent teeth 15 against the opposition of the torsion spring 17. The pawl 21 can be pivoted by a handle 51 (FIG. 1) to a position in which the rod 20 is free to yield to the bias of the torsion spring 17 so that the latter can act upon the lever 30 in a clockwise direction (as seen in FIG. 2), i.e., in a direction to expel the teeth 13 from the adjacent tooth spaces 14. Nevertheless, the arm 31 continues to engage the rack 32 because the rather strong spring 50 (FIG. 1) which serves to bias the back rest 3 forwardly urges the flanks 15*a* of the teeth 15 against the adjacent flanks of the teeth 13 with a force which ensures that frictional engagement between the teeth 13, 15 suffices to prevent the torsion spring 17 from expelling the teeth 13 from the respective tooth spaces 14 as long as no pressure is applied against the back rest 3 in a direction to pivot the back rest rearwardly against the opposition of the spring 50. Thus, the spring 50 for the back rest 3 urges the slide portion 10 to the left, as seen in FIG. 2, and thereby forces the tooth flanks 15*a* against the adjacent teeth 13 with a force which cannot be overcome by the torsion spring 17. Proper circumstances can be selected by the maker of the chair by the simple expedient of properly selecting the bias of the spring 17 and/or by properly selecting the orientation and dimensions of tooth flanks 15*a* so that frictional engagement between the flanks 15*a* and the adjacent teeth 13 suffices to resist the bias of the spring 17 when the spring 50 for the back rest 3 is free to urge the slide portion 10 forwardly toward the front end of the carrier 6 and seat 2.

However, if the occupant of the seat 2 leans backwardly and thereby exerts upon the back rest 3 a pressure which counteracts a portion of the bias of the spring 50 for the back rest 3, the torsion spring 17 is free to pivot the lever 30 in a clockwise direction (as seen in FIG. 2) and to disengage the teeth 13 from the adjacent teeth 15. Thus, the detent means including the elements 11 and 12 is then inactive and the angular position of the back rest 3 with reference to the seat 2 and/or vice versa can be changed at will. It will be seen that the spring 50 for the back rest 3 performs the additional important and useful function of normally maintaining the detent element 12 in engagement with the detent element 11 against the opposition of the torsion spring 17.

The aforediscussed orientation of the tooth flanks 15*a* (so that they extend at right angles to the direction of arrow A and are disposed in planes extending at right angles to the plane of FIG. 2) ensures that the spring 50 for the back rest 3 cannot expel the teeth 13 from their tooth spaces 14 while the spring 50 tends to move the slide portion 10 forwardly.

The positions of the detent elements 11, 12 can be reversed without departing from the spirit of the invention. Furthermore, the number of selected positions can be increased or reduced by the simple expedient of increasing the number of teeth 15 on the rack 32 of the detent element 11. Mutual spacing of the teeth 15, too, can be altered and the length of the slot 9 for the slide portion 10 can be increased or reduced, depending on the desired extent of adjustability of the back rest 3 and seat 2. It is even possible to provide some means (such as one or more pawls or the like) to more or less positively retain the teeth 13 in the selected tooth spaces 14, i.e., to enhance the aforediscussed frictional mating engagement of teeth 13 with the adjacent teeth 15 by a more positive engagement between the detent elements 11, 12 when such elements are called upon to maintain the slide portion 10 in a selected portion of the slot 9, i.e., to hold the back rest 3 in a selected angular position with reference to the seat 2. By way of example, the tooth flanks 15*a* can be provided with sockets for protuberances on the adjacent flanks of the teeth 13 to establish a more reliable engagement between the teeth 13 and the adjacent teeth 15 in each selected position of the slide portion 10 with reference to the slotted portion of the carrier 6.

In order to return the arm 31 of the lever 30 into engagement with the detent element 11, i.e., to fix the back rest 3 in a selected position, the occupant of the chair 1 actuates the mechanism 21, 22 to cause the actuator 22 of such mechanism to stress the coil spring 23 which acts upon the retainer 24 and shifts the motion transmitting rod 20 in the direction of arrow B so as to pivot the lever 30 against the opposition of the spring 17 and to cause the teeth 13 to penetrate into the adjacent tooth spaces 14. The mechanism including the parts 21, 22 is or can be identical with or analogous to that disclosed in the patent to Stucki. The spring 23 ensures that the top lands of the teeth 13 bear against the top lands of the adjacent teeth 15 if the mechanism 21, 22 is actuated at a time when the teeth 13 are not in exact register with a pair of tooth spaces 14. The spring 23 is free to dissipate energy as soon as the slide portion 10 is shifted in its slot 9 to a relatively small extent which is just sufficient to ensure that the spring 23 can propel the teeth 13 into the adjacent tooth spaces 14. It will be seen that the spring 23 renders it possible to ensure automatic engagement of the detent element 12 with the detent element 11 in response to actuation of the mechanism 21, 22 even if such actuation does not result in immediate penetration of teeth 13 into the adjacent tooth spaces 14. At any rate, such actuation of the mechanism 21, 22 ensures that the back rest 3 is thereupon capable of performing only a minute angular movement relative to the seat 2 because such minute movement suffices to enable the stressed spring 23 to propel the teeth 13 into the adjacent tooth spaces 14.

An advantage of the improved chair is that the spring 50 which normally urges the back rest 3 to its foremost position also serves as a means for preventing abrupt forward pivoting of the back rest when the occupant of the chair rises or leans forwardly so that the application of a force upon the back rest (in a direction to pivot the back rest rearwardly) is terminated. The relieved spring 50 then urges the back rest 3 forwardly but such movement is prevented by the slide portion 10 which is connected to the carrier 8 for the back rest and is held by the arm 31 of the lever 30 because the tooth flanks 15*a* in the tooth spaces 14 which receive the teeth 13 bear against the respective teeth 13 with a force which cannot be overcome by the torsion spring 17 until and unless the occupant of the chair again leans backwards and thereby overcomes a predetermined portion of or the entire force of the spring 50 for the back rest 3. The arrangement is preferably such that the torsion spring 17 is free to disengage the arm 31 of the lever 30 from the slide 10 when the occupant of the chair stresses the central portion of the seat 2 and/or leans against the back rest 3. A mere stressing of the front portion of the seat 2 does not suffice to counteract the force of the spring 50 to an extent which is required to enable the torsion spring 17 to disengage the teeth 13 from the adjacent teeth 15. This constitutes a desirable feature of the improved chair because the person applying pressure against the front portion of the seat 2 is not in the danger of being struck by the back rest 3 since the spring 50 is then used to urge the flanks 15*a* against the adjacent teeth 13 and to thus prevent the torsion spring 17 from disengaging the detent element 12 from the detent element 11.

The support 4 (note the carrier 6 of this support in FIGS. 2 and 3) is preferably hollow so that it can accommodate the entire adjusting apparatus including the slide portion 10 and the entire detent means. This is due to the fact that the adjusting apparatus is surprisingly compact. Reference may also be had to FIG. 1 which shows only the handle 51 of the adjusting apparatus beneath the carrier 6; all of the parts of such apparatus are confined in the interior of or are thus shielded by the support 4.

As mentioned above, an important advantage of the improved chair is that the spring 50 can act to urge the back rest 3 forwardly as well as to prevent abrupt forward propulsion of the back rest in response to the application of pressure to the foremost portion of the seat 2 and/or in response to the application of a relatively small pressure against the back rest 3 in a direction to pivot the back rest rearwardly. The occupant of the chair 1 must overcome a predetermined portion of the bias of the spring 50 before the torsion spring 17 is free to disengage the detent element 12 from the detent element 11 on the slide portion 10 and to thus allow for a forward pivoting of the back rest under the action of the spring 50. The occupant of the chair can readily control the extent of forward pivoting of the back rest 3 by bending forwardly once the bias of the spring 50 has been overcome to the extent which is necessary to allow disengagement of the lever 30 from the slide portion 10. Movements of the assembly of parts 2, 3 and 8 are effectively blocked by the spring 50 when the chair is not occupied or when only the front end portion of the seat 2 is acted upon by the weight of the occupant or otherwise. The arrangement may be such that the force which is to be applied to the seat 2 in order to enable the torsion spring 17 to disengage the lever 30 from the slide portion 10 is much greater than the force which must be applied to the back rest 3 in order to allow forward pivoting of the back rest under the action of the spring 50 in deactivated condition of the detent means including the elements 11 and 12.

The spring 50 can be replaced with a gas spring. Moreover, the spring 50 can be used jointly with one or more additional springs. An advantage of simple mechanical springs is their reliability, even after extensive wear, and their lower cost.

Another important advantage of the improved chair is that the disengagement of the detent element 12 from the detent element 11 is smooth and hardly noticeable. This is in contrast to the teaching of the aforementioned European Pat. No. 0 001 846 B1 wherein the locking elements must be moved past hook-shaped complementary components in order to allow an adjustment of the inclination of the back rest. The detent means including the elements 11 and 12 is reliable in that it is not likely to jam and thus prevent disengagement of the lever 30 from the slide portion 10 when such disengagement is desired by the occupant of the chair in order to change the inclination of the back rest.

The detent means of FIGS. 2 and 3 exhibits the advantage that the arm 31 of the lever 30 need not carry a relatively large number of teeth 13. A single tooth 13 or a small number of such teeth suffices to establish the required frictional engagement with the adjacent tooth flank or flanks 15*a* so as to prevent the torsion spring 17 from disengaging the lever 30 from the slide portion 10 when such disengagement is not desired. This contributes to simplicity and lower cost of the detent means. The cost of the chair is further reduced due to the fact that the spring 50 serves as a means for urging the tooth flank or flanks 14 against the adjacent tooth or teeth 13, i.e., it is not necessary to provide discrete springs or other means for maintaining the detent elements 11 and 12 in required and reliable engagement with each other until and unless the occupant of the chair selects to apply the required force to the median or rear portion of the seat 2 and/or to the back rest 3 so as to counteract the force of the spring 50 to an extent which is needed to enable the torsion spring 17 to disengage the arm 31 of the lever 30 from the slide portion 10. It will be seen that frictional engagement between detent elements which is normally undesirable and is sought to be avoided in most instances is used in the improved chair with advantage to allow reliable retention of detent elements 11 and 12 in requisite engagement with each other until and unless the user of the chair decides to overcome such frictional engagement by reducing the bias of the spring 50 upon the slide portion 10 and detent element 11. The spring 50 acts upon the slide portion 10 in the longitudinal direction of the slot 9 and, since the tooth flanks 15*a* of the teeth 15 are disposed in planes which extend at right angles to such direction, the spring 17 is merely called upon to overcome simple friction between the abutting flanks of the teeth 13 and 15 without the need for shifting the slide 10 along the slot 9 in order to disengage the detent element 12 from the detent element 11. Moreover, such configuration and orientation of the flanks 15*a* renders the spring 50 more effective in normally preventing a disengagement of teeth 13 from the teeth 15 under the action of the torsion spring 17. Thus, practically the entire bias of the spring 50 can be used to establish friction between the teeth 13 and 15.

The moving means 20-24 can shift its rod 20 to at least one position in which the bias of the torsion spring 17 suffices (after adequate reduction of the bias of the spring 50 upon the slide portion 10) to disengage the teeth 13 from the teeth 15. The handle 51 which is shown in FIG. 1 can be used to urge the rod 20 forwardly (through the medium of the spring 23) until the slide portion 10 reaches a position in which two tooth spaces 14 register with the teeth 13 so that the rod 20 is then free to pivot the lever 30 in a counterclockwise direction (as seen in FIG. 2) and to effect penetration of the teeth 13 into the adjacent tooth spaces 14 so as to enable the spring 50 to thereupon oppose the bias of the spring 17 and ensure that frictional engagement between the tooth flanks 15*a* and the adjacent teeth 13 suffices to maintain the back rest 3 in the newly selected position of inclination.

The spring 23 of the moving means 20–24 constitutes an optional but desirable feature of the improved seat. As explained above, this spring ensures that the teeth 13 find their way into the adjacent tooth spaces 14 even if the initially selected angular position of the back rest 3 is such that the the lands of the teeth 13 abut the top lands of neighboring teeth 15, i.e., if the teeth 13 cannot immediately engage the flanks 15*a* of two neighboring teeth 15. The occupant then simply changes the inclination of the back rest 3 to a negligible extent so as to reach the nearest selected position in which the teeth 13 are free to enter the adjacent tooth spaces 14.

An additional important advantage of the improved chair is the compactness of its adjusting apparatus. Such apparatus need not employ a gas spring and it can be confined in the support 4 so that it does not detract from the appearance of the chair.

Figure 4:
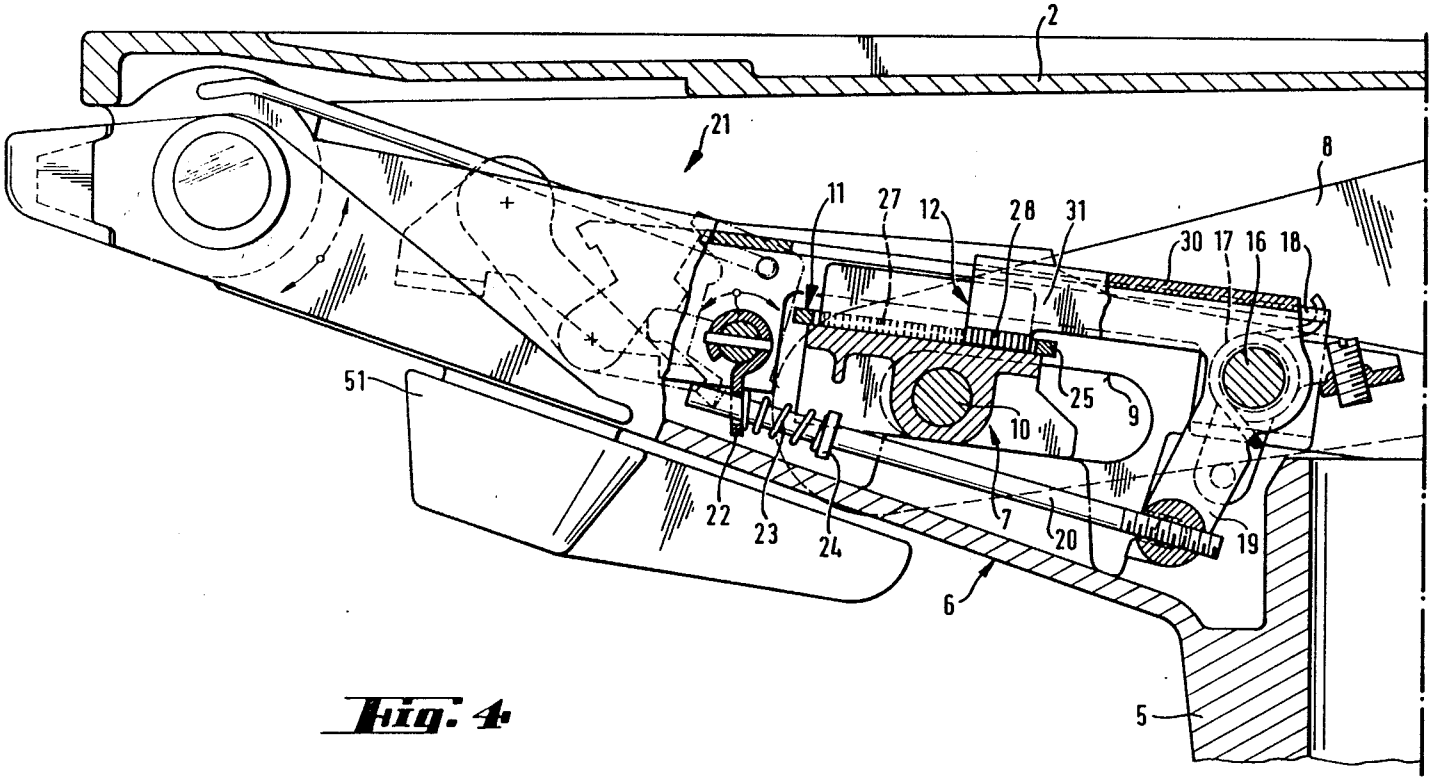
FIG. 4 is a vertical sectional view of the support and of modified coupling means.
Figure 5:
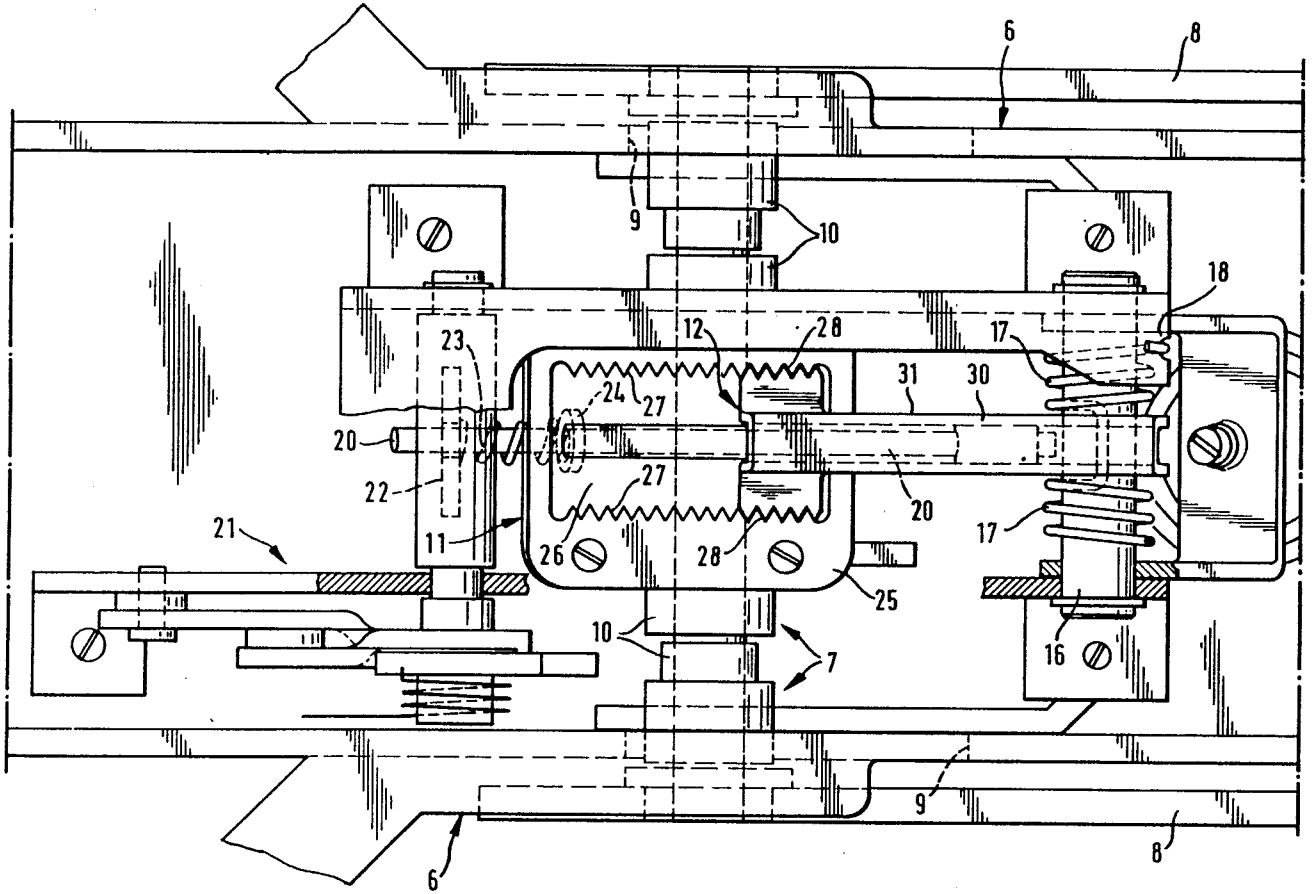
FIG. 5 is an enlarged horizontal sectional view of the support and coupling means shown in FIG. 4.

FIGS. 4 and 5 show a portion of a modified chair wherein the detent element 11 on the slide portion 10 in the slot 9 of the carrier 6 for the seat 2 includes a plate-like toothed rack 25 with an opening 26 in the form of a window flanked by two rows of teeth 27 with each row extending in the longitudinal direction of the slot 9 and seat 2.

The lever 30 forms part of a second detent element 12 and its arm 31 has two sets of teeth 28 with each set movable into mesh with the teeth 27 of the adjacent row when the arm 31 is caused to enter the opening 26 of the plate-like rack 25. The thickness of the rack 25 is preferably less than one centimeter, e.g., in the range of two, three or four millimeters, and the depth of penetration of teeth 28 into the opening 26 (i.e., into the tooth spaces between the teeth 27 of the respective rows) equals or approximates the thickness of the rack 25. An advantage of such design is that a relatively small angular displacement of the lever 30 suffices to ensure the establishment of a predictable and reliable frictional engagement between the teeth 27 and the adjacent teeth 28 in order to hold the slide portion 10 and the back rest on selected positions with reference to the seat and carrier 6. Thus, the back rest retains its angular position when it is not actuated upon by a force which tends to pivot it rearwardly.

The number of teeth 28 on the arm 31 of the lever 30 can be reduced to less than or increased above the illustrated number. It has been found that two sets of five teeth 28 each will ensure a highly satisfactory retention of the slide portion 10 on a selected position with reference to the slot 9. By increasing or reducing the number of teeth 28 in each of the two sets, the maker of the improved chair can select in advance the force which is required to enable the torsion spring 17 to disengage the arm 31 from the rack 25 in response to the application of a given pressure against the back rest. The just discussed force is also dependent upon the orientation of those flanks of the teeth 27 which are engaged by the respective teeth 28.

Without further analysis, the foregoing will so fully reveal the gist of the present invention that others can, by applying current knowledge, readily adapt it for various applications without omitting features that, from the standpoint of prior art fairly constitute essential characteristics of the generic and specific aspects of my contribution to the art and, therefore, such adaptations should and are intended to be comprehended within the meaning and range of equivalence of the appended claims.

I claim:

1. A chair comprising a leg including a support having first and second carriers; a seat on said first carrier; a back rest on said second carrier; and means for movably coupling said carriers to each other, including a slotted portion provided on one of said carriers, a slide portion provided on the other of said carriers and movable in said slotted portion between a plurality of positions in and counter to a predetermined direction, and detent means including cooperating first and second detent elements which are movable relative to each other and are respectively provided on said slide portion and said one carrier and have means for releasably holding said slide portion in selected ones of said plurality of positions.

2. The chair of claim 1, wherein said holding means include complementary teeth extending transversely of said direction and being in frictional mating engagement in each of said selected positions in the absence of transmission of stresses to the second carrier by said back rest.

3. The chair of claim 2, wherein said first detent element includes a toothed rack having tooth spaces, at least one for each of said selected positions, said second detent element including a holder and means for movably mounting said holder on said one carrier, said holder having at least one tooth and said at least one tooth being received in a different tooth space in each of said selected positions.

4. The chair of claim 3, wherein said holder includes a lever which is pivotally mounted on said one carrier and has at least one arm, said at least one tooth being provided on said arm.

5. The chair of claim 3, further comprising means for biasing said at least one tooth against the adjacent tooth of said rack in each selected position of said slide portion in the absence of transmission of stresses from the seat and/or back rest.

6. The chair of claim 3, wherein the teeth of said rack have flanks which are engaged by said at least one tooth in the corresponding selected positions of said slide portion, said flanks being disposed in substantially parallel planes extending substantially at right angles to said direction.

7. The chair of claim 3, further comprising means for yieldably urging said holder in a direction to disengage said at least one tooth from said rack.

8. The chair of claim 7, further comprising means for moving said holder against the opposition of said urging means so as to engage said at least one tooth with said rack.

9. The chair of claim 8, wherein said moving means includes a motion transmitting member movable to a releasing position in which said urging means is free to disengage said at least one tooth from said rack.

10. The chair of claim 7, wherein said holder includes a pivotable bell crank lever including a first arm for said at least one tooth and a second arm, and further comprising means for pivoting said lever in a direction to engage said at least one tooth with said rack, said pivoting means including a motion transmitting member connected with said second arm and a mechanism for moving said motion transmitting member.

11. The chair of claim 10, wherein said moving means further comprises an elastic cushion between said mechanism and said motion transmitting member.

12. The chair of claim 11, wherein said motion transmitting member includes a rod which is reciprocable by said lever and by said mechanism and includes a retainer for said cushion, said mechanism including an actuator for said rod and said cushion including a spring reacting against said actuator and bearing against said retainer.

13. The chair of claim 3, wherein said rack has an opening extending in said direction and at least one row of teeth disposed in said opening and extending in said direction, said second detent element having at least one tooth movable into and from said opening to engage a different tooth of said row in each selected position of said slide portion.

14. The chair of claim 13, wherein sLid rack has an additional row of teeth parallel to said at least one row, said second detent element having at least one additional tooth movable into and out of mesh with the teeth of said additional row.

15. The chair of claim 14, wherein said second detent element has a first set of several teeth movable into and out of mesh with the teeth of said at least one row and a second set of several additional teeth movable into and out of mesh with the teeth of said additional row.

16. The chair of claim 13, wherein said rack includes a plate having a thickness of less than one centimeter and said at least one tooth has a depth which at least approximates said thickness.

17. The chair of claim 1, wherein said support is hollow and said detent means is installed in said support.

18. A chair comprising a leg including a support having front and rear carriers; a seat on said front carrier; a back rest on said rear carrier; means for movably coupling said carriers to each other so that the rear carrier is movable forwardly and backwards with reference to said front carrier, including a slotted portion on said front carrier, a second portion provided on said rear carrier and movable forwardly and backwards in said slotted portion between a plurality of positions, first teeth provided on said second portion, a lever pivotably mounted on said front carrier and having second teeth adjacent said second portion, and means for pivoting said lever in a first direction to engage said second teeth with said first teeth in a selected position of said second portion in said slotted portion; first spring means for biasing said lever in a second direction to disengage said second teeth from said first teeth; and second spring means for biasing said second portion in a direction to maintain said second teeth in frictional engagement with said first teeth with a force which exceeds the bias of said first spring means, said back rest being pivotable backwards with reference to said seat to thereby reduce the force of said second spring means upon said second portion and to thus permit disengagement of said second teeth from said first teeth under the action of said first spring means so that said second portion can be moved in said slotted portion to any one of said plurality of positions.

* * * * *